United States Patent [19]

Drinkard, Jr.

[11] 3,956,087

[45] May 11, 1976

[54] ELECTROCHEMICAL MINING OF COPPER

[75] Inventor: William F. Drinkard, Jr., Charlotte, N.C.

[73] Assignee: Mineral Research & Development Corporation, Charlotte, N.C.

[22] Filed: May 17, 1974

[21] Appl. No.: 470,810

[52] U.S. Cl. ..... 204/107; 204/113; 204/123

[51] Int. Cl.[2] ..... C25C 1/12; C25C 1/06; C25C 1/24; C25C 7/08

[58] Field of Search .....204/105–108, 113, 123

[56] References Cited

UNITED STATES PATENTS

| | | | |
|---|---|---|---|
| 556,092 | 3/1896 | Frölich | 204/111 |
| 636,321 | 11/1899 | Craney | 204/108 |
| 822,175 | 5/1906 | Wolcott | 204/105 R |
| 2,404,206 | 7/1946 | Arvidson | 204/108 |
| 2,646,396 | 7/1953 | Dean | 204/281 |
| 2,761,829 | 9/1956 | Dolloff | 204/106 |
| 3,616,277 | 10/1971 | Adamson et al. | 204/10 |
| 3,673,061 | 6/1972 | Kruesi | 204/107 |

FOREIGN PATENTS OR APPLICATIONS

| | | | |
|---|---|---|---|
| 14,353 | 7/1964 | Japan | 204/281 |
| 910,844 | 9/1972 | Canada | 204/281 |

OTHER PUBLICATIONS

"Modern Electroplating" by F. A. Lowenheim, 2nd Ed., 1963, p. 737.

"Modern Electroplating" by F. A. Lowenheim, 2nd Ed., 1963, p. 34.

*Primary Examiner*—R. L. Andrews
*Attorney, Agent, or Firm*—Herbert M. Adrian, Jr.

[57] ABSTRACT

A method is described for the direct extraction of copper as finely divided metal from subterranean sulfide ore deposits containing the same utilizing electrochemical techniques. The method eliminates the physical digging and crushing of ore and greatly reduces subsequent refining and further purification of the recovered copper. Copper produced in accordance with the method can, in many instances, be used in the recovered form. Alternative processing techniques are described for simultaneously producing both finely divided copper and finely divided iron from sulfide ores containing the same.

10 Claims, No Drawings

ELECTROCHEMICAL MINING OF COPPER

INTRODUCTION

This invention relates to the electrochemical mining of copper containing sulfide ores from earth deposits, and more particularly to the electrolysis of sulfide ore deposits while still beneath the earth's surfaces and conducting such electrolysis so as to recover metallic copper and, additionally, metallic iron when the sulfide deposit additionally contains iron.

BACKGROUND OF THE INVENTION

It has previously been suggested to directly mine metal values from sulfide ores. While theoretically the idea is quite feasible from an engineering standpoint, previous attempts to accomplish such electrochemical mining met with limited success. Initially, the reaction would proceed as theorized, but after only a relatively short application of electrical current to the ore body, the electrodes would polarize due to the buildup of an insulating shield of sulfur on the surface of the ore. Current efficiencies would rapidly deteriorate and the electrolysis would slow to an unacceptable rate. Continued application of electrical energy would soon result in total polarization of the electrodes and termination of economic electrolysis.

Applicant's co-pending application Ser. No. 470,807 sets forth a method whereby these difficulties and shortcomings have been overcome to thereby efficiently and continuously electrochemically mine metal values from sulfide ore deposits. Having solved the problem of continuous electrolysis, it has become apparent that it is more desirable to recover the valuable metals from such sulfide ore deposits in a condition which minimizes subsequent refining and purifying of the metal values. Additionally, because most valuable sulfide ore deposits would be preferably worked for their copper values, it is desirable to obtain the copper from said deposits as metallic copper in a state which can be either utilized as recovered or which requires a minimum of further refining and purification. Many of such sulfide ore deposits additionally contain another metal, the more frequent metal found in combination with copper being iron. Often times, such iron is present in a substantial proportion of the metal values. Under such circumstances, it is often desirable to additionally recover the iron in a purified form as possible to likewise reduce further purification and refining steps.

It is therefore an object of the present invention to provide a method for electrochemically mining copper sulfide ore bodies and the direct recovery from said ore bodies of metallic copper values.

It is an additional object of the present invention to provide a method for simultaneously reducing both copper and iron in sulfide ore bodies containing the same to produce finely divided copper and iron.

These and other objects of the present invention will become apparent to those skilled in the art from the description of the invention which follows.

THE INVENTION

In accordance with the invention, a method is provided for the direct extraction of copper values from earth deposits of copper containing sulfide ores comprising attaching a positive source of direct current to a deposit of copper containing sulfide ore to form an anode, contacting said ore with a halogen salt containing electrolyte, positioning a cathode in said electrolyte, passing a decomposition voltage from said anode to said cathode to decompose said anode, said decomposition voltage being sufficient to reduce copper at the cathode but below that required for reducing iron, said electrolyte having a pH of less than about 5 and a halogen ion concentration of at least about 1 molar.

Further, in accordance with the method of the present invention, both copper and iron are reduced and precipitated from said electrolysis utilizing a titanium cathode and a decomposition voltage sufficient to reduce said iron.

Additional processing techniques are also described wherein electrolyte is continuously or periodically withdrawn from the electrolysis, preferably from the catholyte compartment, so as to withdraw therewith precipitated copper values. Electrolyte recirculation methods are also described wherein the buildup of sulfate ions and other metal values are removed in useful form.

It will further be recognized that the present process eliminates the need to bring ore deposits to the earth's surface and the additional processing steps often used in conventional mining such as crushing, acid leaching, concentration of ore and the like. Because the process can be controlled to bring only the useful products to the earth's surfaces, waste disposal is eliminated as well as contamination of surface waters in the washing or leaching of of ores. Noxious fumes are not emitted such as is the case with conventional sulfide ore smelting wherein sulfur dioxide fumes may be conventionally vented to the atmosphere.

DETAILS OF THE INVENTION

The present invention is utilized for in-place electrolysis of sulfide ore bodies in subterranean locations. Briefly stated, a source of direct electrical current is connected to the subterranean ore deposit. The ore deposit then becomes the anode when direct electrical current is applied. The source of direct current is best attached to the sulfide ore deposit by exposing the ore if it is near the earth's surface or by sinking a well or shaft into the ore body.

The negative terminal of the direct electrical current source is connected to a cathode which is positioned within a second well or shaft penetrating into the ore body. The second cathode containing shaft is filled with electrolyte which makes contact with the sulfide ore deposit. One or many such cathode containing shafts can be utilized with a single anode attachment.

The distance between anode attachment and cathode can vary greatly because copper containing sulfide ore deposits are highly conductive and very little energy loss is encountered even with widely separated anode attachment and cathode placement. With less conductive sulfide ore deposits which may be encountered under certain geological conditions, the anode attachment can be positioned in close proximity to cathode, such as within a few yards. For most sulfide deposits, however, the anode attachment can be as far away as the extremities of the deposit, i.e. hundreds of yards away from the cathode placement.

The vertical well or shaft which contains the cathode, technically referred to as the catholyte compartment, is preferably sealed to enclose the electrolyte into a catholyte compartment at a position at the beginning or within the ore body. Electrolyte withdrawal means such as pumps and pipes and electrolyte return means such as return pipes are provided to provide means for continuously or periodically withdrawing and replenishing of electrolyte solution. In the operation of the process, a preselected decomposition voltage is applied between the anode and the cathode, thus decomposing sulfide ore in contact with the electrolyte. Metal values enter the electrolyte and, depending upon the decomposition voltage, metals are reduced at the cathode. Again, depending upon the decomposition conditions utilized, electrolyte concentration will change as the electrolysis proceeds and therefore means for withdrawing product and/or electrolyte are preferably utilized to maintain continuous operation. The excessive buildup of certain ions can result in the polarization of electrodes and/or the precipitation of certain metal and cation values which otherwise are desirably recovered.

Many copper containing sulfide ore deposits contain more than one metal which is desirably recovered. In accordance with the present invention, the decomposition voltage can be maintained so as to reduce copper values and all other metal values having a lower electromotive force. Operating under such conditions, copper values can thus be recovered in substantially pure form separate from other commonly found metals of a higher electromotive force such as iron.

In many widely found sulfide ores both copper and iron are found in varying and substantial proportions. The electrolysis conditions can under such circumstances be controlled to yield the copper in reduced metallic form and iron in solution or both copper and iron in reduced metallic form. In such electrolysis, sulfide ions continue to go into the electrolyte solution, thus increasing the concentration of such such sulfate ions. These ions are often desirably removed to control the sulfate ion content within desired limit in the electrolyte. Therefore, circulatory means as described can be utilized to withdraw electrolyte, lime such electrolyte to form calcium sulfate and thereby enabling recovery of sulfate values as a commercially salable product.

In accordance with one embodiment of the present invention, the decomposition voltage is applied such that copper and all metals below copper in the electromotive series will be reduced at the cathode. Because many of the sulfide ores which contain copper also contain other metals, such as nickel, iron, lead, palladium, silver, cobalt, cadmium and the like, such metals although normally present in very minor amounts are also deposited along with the copper. Metals above copper, such as iron, nickel and the like, are not deposited but rather remain in solution. Thus, the metals recovered utilizing a decomposition voltage sufficient to reduce copper such as that in the range of 1 to 2 volts, will result in copper which contains the corresponding trace amounts of the metals below copper on the electromotive series such as silver and palladium.

In accordance with a further embodiment of the present invention, the decomposition voltage is increased to that at which iron is reduced at the cathode. The iron as well as all metals below it in the electromotive series are thus reduced. Since iron requires a higher voltage, i.e. theoretically 0.76 volts higher than copper, the decomposition voltage is increased accordingly. Because the electrolyte, electrodes used, hydrogen over-voltage, and the like properties come into play in determining the exact voltage, such voltage is best determined empirically for the given electrolysis.

The cathode preferably utilized in the present invention is a titanium cathode. While other cathodes can be utilized, the reduced metals normally will adhere to the cathode thus requiring periodic removal of the cathode to recover the metal. However, with the utilization of a titanium cathode, the metal being reduced there does not adhere to the cathode surface and consequently precipitates to the bottom of the catholyte compartment as finely divided metal. This greatly facilitates the periodic or continuous removal of the metal from the subterranean electrolysis.

The electrolyte utilized in the electrolysis contains at least 1 molar amount of halogen up to the saturation point of the halide at the operating temperatures. The halide ion is added preferably as an alkali metal, alkalineearth metal salt or acid thereof and mixtures of salt and acid. Thus, the molar concentration referred to is that of the salt and/or acid. While all of the various halides including chloride, bromide, fluoride, and iodide can be used, as a practical matter only the chloride is normally economically feasible. Of the chloride salts, sodium chloride is the most preferred although lithium chloride, potassium chloride, calcium chloride, magnesium chloride, barium chloride and the like can be used with correspondingly good results. The particular choice of halide salt rests largely on economical considerations and the availability of the salt at the particular mining site. In addition to utilizing a halide salt to achieve the desired halogen ion concentration in the electrolyte, the corresponding halide acid can be used to increase the halide ion content while acidifying the electrolyte to the desired pH. Thus, when utilizing chloride as the halogen, hydrochloric acid is preferably used to adjust the pH to the desired level and to increase conductivity.

The concentration of halogen ion in the electrolyte requires at least a 1 molar concentration up to the saturation point of the halide. Such concentrations are often measured in terms of Baume which means that the electrolytes of the present process are at least 6Be. It is preferred that the electrolyte be at least 10 Be, with the most preferred electrolytes being in the range of 15 to 23 Be. With sodium chloride, this represents a solution having a preferred molar concentration of 2 to 4 molars, it being recognized that the addition of acid such as hydrochloric acid will increase the Be particularly with the lower salt concentrations.

Concentrations below about 1 molar, while effective in initiating electrolysis, will not sustain electrolysis beyond a period of several hours without resulting in polarization. On the other hand, while a saturated electrolyte solution may in some instances be desirable, it should be recognized that various other ions particularly sulfate and metal values will be going into the electrolyte solution on the continuation of electrolysis. Thus, unless a correspondingly high electrolyte circulation is maintained or other compensating factors used, precipitation of certain ions or salts may occur as the electrolysis continues. Under certain circumstances, such precipitation is desirable provided the precipitate is an ion which is desirably removed from the electrolyte as the reaction proceeds. It should further be recognized that in such subterranean electrolysis ground water dilution of the electrolyte can occur, thus making it desirable to utilize more concentrated electrolytes so as to maintain the most desired concentration in the electrolysis environment.

The acidity of the electrolyte is adjusted to below a pH of about 5. This is preferably accomplished by addition of the corresponding halide acid such as hydrochloric acid. However, any of the various other strong acids such as sulfuric acid and the like can be used with correspondingly good results. The acidity can range down to a pH of less than 1, i.e. as low as about a pH of 0.01. While such low pH's are useful as electrolyte feed to the electrolysis area where ground water leakage tends to dilute the acidity, the more preferred pH is in the range of about 1.5 to 3.5.

The electrolysis can be carried out at temperatures ranging from that of the sulfide ore, i.e., ambient temperature, up to the boiling point of the electrolyte. However, it is preferred to allow the electrolyte to seek its own temperature recognizing that heat will be generated by the electrical input and, thus, no heating or cooling is necessary. It is further recognized that higher electrolysis temperatures such as those in the range of about 40° to 90°C improve current efficiencies. Therefore, temperatures in this range are peferred and are readily sustained in the electrolysis if desired.

The decomposition voltage applied has been set forth as preferably being between 1 and 2 volts for the reduction of copper without corresponding reduction of iron. In the simultaneous reduction of both copper and iron values, the decomposition voltage must be increased so as to be inclusive of iron, although it can be substantially higher than the lower limit at which iron will be reduced at the cathode. The particular current density utilized can also be varied in accordance with the particular electrolysis conditions. In general, the electrolysis is carried out by applying as high a current density as can economically be maintained so as to effect the reduction of the desired metal values as rapidly as possible. Such current densities can vary from about 0.01 to 1 or more amperes per square centimeter and more preferably in the range of 0.05 to about 0.6 amperes per square centimeter.

In a preferred embodiment of the present invention, the electrolysis is carried out within the specified preferred ranges with electrolyte being continuously or periodically withdrawn and replenished while the electrolysis is continuously effected. Utilizing the decomposition voltage for the reduction of copper and a titanium electrode, electrolyte withdrawal means are located so as to draw electrolyte from the bottom of the catholyte compartment, thereby withdrawing precipitated metal values. Such metal values are recovered by filtration or decanting, and the electrolyte filtrate is subsequently treated to recover the useful ions in the electrolyte. A preferred method for removing sulfate ions is by liming the filtrate to form and precipitate calcium sulfate. The calcium sulfate is separated, such as by decanting or filtration. When the electrolysis is carried out so as to recover metallic copper and retain iron in solution, the filtrate pH is increased to precipitate ferrous and ferric hydroxide as well as other insoluble ions. Typically, alkali metal hydroxide such as sodium or potassium hydroxide or ammonium hydroxide can be utilized for this purpose. Wherein sodium hydroxide is utilized to increase the pH, the halogen ion content can be readily reestablished by the addition of hydrochloric acid in the electrolyte adjustment step. The precipitated ferrous and ferric hydroxide is filtered or decanted and the filtrate readjusted so as to have the desired acidic pH and halogen ion content as described hereinbefore. The adjusted electrolyte is then returned to the electrolysis.

Alternatively, when the electrolysis is carried out with a decomposition voltage such as to reduce iron, the increase in the pH can be eliminated and the filtrate from the liming step can be merely readjusted in pH and halogen ion content prior to returning to the electrolysis.

The following example illustrates certain preferred embodiments of the present invention. Unless otherwise indicated, all parts and percentages used herein are by weight and all temperatures in the example and claims are in degrees centigrade.

EXAMPLE I

The process of the present invention is carried out by drilling vertical shafts into a sulfide ore body comprised of pyrite ($FeS_2$) and chalocopyrite ($CuFeS_2$). A conductor is attached to one vertical shaft in the sulfide ore body to form an anode of the sulfide ore body. A second vertical shaft for the cathode is drilled several yards away. A titanium cathode is placed in the center of the second vertical shaft and the outlet end sealed to form a watertight compartment. Electrolyte feed means and withdrawal means are located so as to circulate electrolyte to and from the enclosed cathode compartment.

Electrolyte comprised of 18 Be sodium chloride adjusted with hydrochloric acid to a pH of 2.0 is fed into the catholyte chamber. A decomposition voltage of direct current at 1.75 volts is applied between the sulfide ore body anode and the cathode. The current density is maintained at about 0.3 amperes per square centimeter. Electrolyte solution is continuously withdrawn and replenished with electrolyte adjusted to 18 Be sodium chloride at a pH of 2.0. Free metallic copper is precipitated at the cathode and withdrawn with the electrolyte solution. The finely divided copper is separated by filtration and the filtrate limed by the addition of calcium oxide or other alkali to increase the alkalinity. Air may be added during liming to form salable iron oxide precipitate or the iron recovered as ferrous and ferric hydroxide. Hydrochloric acid is then added to the residual filtrate to reduce the pH to 2.0 and sufficient sodium chloride is added to adjust the electrolyte to 18 Be prior to returning to the electrolysis.

EXAMPLE II

In the manner of Example I, the decomposition voltage is increased to reduce iron at the cathode. The current density is increased to about 0.5 amperes per square centimeter and the voltage increased to 4 volts. Electrolyte withdrawal means, circulating from the catholyte compartment, withdraws free metallic copper and iron. The withdrawn electrolyte is filtered to recover free metal, the electrolyte limed to remove sulfate ions as calcium sulfate. The filtrate of the limed solution is then readjusted to 18 Be sodium cloride and a pH of 2.0 and returned to the electrolysis.

While there have been described more particularly various preferred embodiments of the present invention, it will be readily recognized by those skilled in the art that various modifications herein can be made without departing from the spirit of the invention. As such, it is intended to cover the invention broadly, being limited only by the following claims.

What is claimed is:

1. A method for the direct extraction of copper values from earth deposits of copper containing sulfide ores comprising attaching a positive source of direct current to a deposit of copper containing sulfide ore to form an anode, contacting said ore with a halogen salt containing electrolyte, positioning a cathode in said electrolyte, passing a decomposition voltage from said anode to said cathode to decompose said anode, said decomposition voltage being sufficient to deposit copper at the cathode but below that required for depositing iron, said electrolyte having a pH of less than about 5 and a halogen ion concentration of at least about one molar.

2. The method of claim 1 wherein current voltage is in the range of 1 to 2.0 volts.

3. The method of claim 1 wherein the current density is within the range of 0.01 to 1.0 amperes per square centimeter.

4. The method of claim 1 wherein the cathode is comprised of titanium.

5. The method of claim 1 wherein the electrolyte is continuously or periodically withdrawn from the electrolysis, the sulfate values and soluble metal values having an electromotive force greater than copper are removed, electrolyte halogen ion concentration and pH are adjusted and the electrolyte returned to the electrolysis.

6. The method of claim 5 wherein the cathode is comprised of titanium and the copper reduced thereon precipitates to the bottom of the catholyte compartment and said withdrawal of electrolyte is from the bottom of said catholyte compartment to remove said precipitated copper.

7. The method of claim 6 wherein the withdrawn electrolyte is filtered to remove and recover said precipitated copper.

8. The method of claim 1 wherein the copper sulfide ore additionally contains iron and the decomposition voltage is maintained at or above that required for depositing iron at said cathode, thereby simultaneously depositing both copper and iron.

9. The method of claim 8 wherein the cathode is comprised of titanium and the copper and iron reduced thereon precipitates to the bottom of the catholyte compartment.

10. The method of claim 9 wherein electrolyte is continuously or periodically withdrawn from the bottom of the catholyte compartment and filtered to remove and recover said precipitated copper and iron.

* * * * *